United States Patent [19]

Kato

[11] 4,375,201

[45] Mar. 1, 1983

[54] FIXING APPARATUS

[75] Inventor: Chiaki Kato, Osaka, Japan

[73] Assignee: Sumimoto Electric Industries, Ltd, Osaka, Japan

[21] Appl. No.: 262,245

[22] Filed: May 11, 1981

[30] Foreign Application Priority Data

May 13, 1980 [JP] Japan ..... 55-63133

[51] Int. Cl.[3] ..... B05C 11/105

[52] U.S. Cl. ..... 118/60; 118/101; 118/104; 118/264

[58] Field of Search ..... 118/60, 70, 264, 101, 118/104; 432/60

[56] References Cited

U.S. PATENT DOCUMENTS 4,170,957 10/1979 Eddy et al. ..... 118/60

4,309,957 1/1982 Swift ..... 118/60

*Primary Examiner*—Evan K. Lawrence

*Attorney, Agent, or Firm*—Sughrue, Mion, Zinn, Macpeak and Seas

[57] ABSTRACT

An apparatus for fixing a toner-image by transporting a toner image bearing material as it is held between a heated fixing roll and a compression roll. The apparatus uses a porous tube of tetrafluoroethylene resin with both ends sealed which is placed in contact with the fixing roll in an axial direction and a release agent is applied onto the surface of the fixing roll through the porous tube.

7 Claims, 4 Drawing Figures

FIXING APPARATUS

BACKGROUND OF THE INVENTION

The present invention relates to an apparatus for applying silicone oil onto the surface of the fixing roll of a plain paper copying (PPC) machine.

In the fixing mechanism of a PPC machine, paper bearing transferred toner particles is passed between a heated fixing roll and compression roll made of rubber or other elastic material under pressure at a predetermined temperature in order to fix the toner image. In this mechanism, there is a tendency for the paper bearing toner particles to become wound around the fixing roll or elastic compression roll thereby preventing complete printing or jamming the machine. To avoid these problems, various techniques have been proposed.

All conventional types of fixing mechanisms apply a coating of a release agent onto the surface of the fixing roll and compression roll. It is however very difficult to apply a release agent coating uniformly and in the right amount. If the amount is too large, the agent forms a blotch on the paper or discolors it. At the same time, rapid consumption of the agent requires its frequent and uneconomical refilling. Furthermore, excess release agent coagulated on the roll surface can cause unexpected trouble with the machine. If too small an amount of the release agent is applied, the releasability of the roll surface from paper is unavoidably reduced leading to the problem of the paper being wound around the roll. Typical release agents are silicone oil and other heat-resistant oils.

Conventional applicators for the release agent include the following:

(1) An applicator wherein the fixing roll or compression roll is partially immersed in the release agent and excess release agent is scraped off the roll with a doctor blade or other suitable device; and (2) An applicator wherein the release agent is applied to an intermediate roll before being transferred onto the fixing roll. This type of applicator is shown in accompanying FIG. 3 wherein reference numeral 11 designates a release agent supply jig, 12 an intermediate roll, 14 the fixing roll (heating roll), 15 an elastic compression roll, and 16 the copy paper.

The first and second applicators cannot apply a uniform coating of release agent and tend to apply an excessive amount of the agent so that the problems described above arise. In addition, they not only consume the agent too rapidly but also require a large installation space.

SUMMARY OF THE INVENTION

This invention has been accomplished on the basis of our efforts to eliminate the defects of the above-described prior art applicators for a release agent while applying a highly uniform coating of the release agent. This invention provides a release agent applicator for use in a copying machine having a fixing roll wherein the release agent is applied onto the surface of the fixing roll through a porous tube made of tetrafluoroethylene. Since the porous tube is flexible, it is preferably fixed to a supporting member. The applicator of this invention is particularly advantageous for use in a small-size copying machine which does not allow the installation of a large applicator.

DESCRIPTION OF THE PREFERRED EMBODIMENTS

Figure 1A:
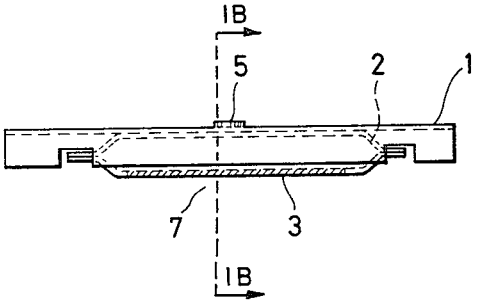
FIG. 1A is a front view of a release agent applicator according to a first embodiment of the invention in which a porous tube of tetrafluoroethylene resin is heat sealed at both ends and is supported by a member having a central inlet for release agent.

A porous tube of tetrafluoroethylene resin of the type preferred for use in the applicator of the invention is described in Japanese Published Patent Application No. 13560/67 and U.S. Pat. No. 4,082,893. This tube is produced by extruding a tetrafluoroethylene resin mix containing a liquid lubricant into a tubular form, then drawing and baking the thusly formed tube. Such a porous tube has fine pores of a uniformly controlled size, preferably in the range of from 0.1 to 10 $\mu$m, a porosity of 50 to 85%, an outside diameter of 5 to 50 mm and a wall thickness of 0.1 to 5 mm. An example, of this tube is available from Sumitomo Electric Industries, Ltd. under the trade name "Poreflon TM" tube. The outer curved surface of the tube in the area other than where the release agent is oozed out is covered with fluorocarbon rubber or other materials to close the pores in that area, and both ends of the tube are closed by heat sealing. The tube is then fixed to a support member in such a manner that the area of the tube where the pores are open is in contact with the fixing roll. The tube has a rubber sheet or plug (1–20 mm thick) attached to a part of the area of the tube other than the area where the pores are open or, alternatively, a hole in that part of the support which is in contact with the tube is closed with the rubber sheet. Instead of closing both ends of the tube by heat sealing, the ends may be covered with the rubber sheet. The release agent is injected into the tube with a syringe or other device through the rubber sheet. Therefore, the rubber sheet serves as an inlet for the release agent. The pore size, porosity, outside diameter and wall thickness of the porous tube may be varied freely depending on the viscosity of the release agent, typically silicone oil, and the amount to be applied.

The support member may be made of metal, plastic or other suitable materials. The porous tube of tetrafluoroethylene resin can be fixed to the support member by rubber vulcanization, with an adhesive, or by holding it in a groove provided in the support member. The support can be provided with a suitable shape depending upon the configuration of the fixing assembly of the copying machine.

The invention will now be described in greater detail with reference to the following examples which are given here for illustrative purposes only and are by no means intended to limit the scope of the invention.

EXAMPLE 1

A porous tube of tetrafluoroethylene resin (a tube of "Poreflon TM" manufactured by Sumitomo Electric Industries, Ltd.) having a pore size of 1 $\mu$m, a porosity of 75%, an outside diameter of 11 mm and a wall thickness of 1 mm was covered with a coating of a 20% solution of a fluorocarbon rubber blend containing a vulcanizing agent. The solution was applied to the entire area of the outer surface of the tube except areas where the pores had to remain open. After drying and vulcanizing the coating, the tube was cut to a length equal to that of the fixing roll. Both ends of the tube were heat sealed at a pressure of 4 kg/cm$^2$ and a temperature between 800° and 1100° C. for about one minute. This tube is schematically represented in FIG. 1 wherein reference numeral 7 indicates the porous tube and 2 designates the area having closed pores.

Figure 1B:
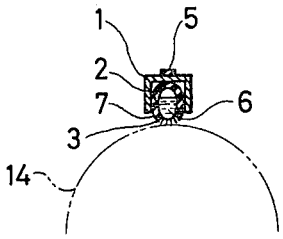
FIG. 1B is a cross-sectional view of the applicator.

A support member of the shape shown at 1 in FIG. 1 was made from a steel plate with a central 5 mm diameter hole closed with a silicone rubber plug 3 mm thick. The surface of the support member that was to contact the tube was roughened, such as by honing (sand blasting) or sand papering, and the roughened surface was coated with fluorocarbon rubber containing a vulcanizing agent. The separately prepared tube 7 with both ends heat sealed was forced into the groove of the support member until the tube contacted the silicone rubber with the area 3 having open pores on the side opposite the contacting face of the tube. The support 1 was fixed to the tube 7 by placing the support 1 and the tube 7 in a constant temperature bath at 180° C. for 3 hours. As a result of this vulcanization, a release agent applicator as shown in FIG. 1 was produced.

Silicone oil 6, such as #KF 96 (1000 cS), was injected into the porous tube through an inlet 5 convered with silicone rubber. A few minutes later, the silicone oil oozed out through the area of the porous tube where the pores were open.

EXAMPLE 2

Figure 2:
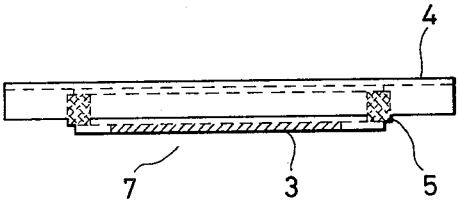
FIG. 2 is a front view of a release agent applicator according to another embodiment of the invention wherein the release agent is supplied through both ends of the porous tube of tetrafluoroethylene resin.
Figure 3:
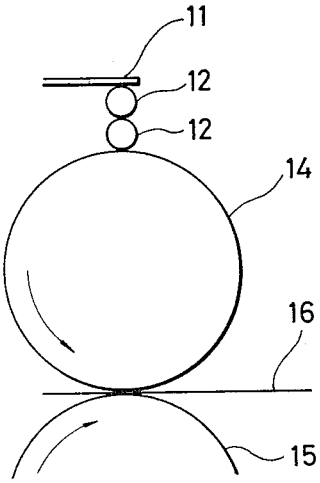
FIG. 3 is a side view of a conventional release agent applicator having an intermediate roll.

A porous tube of tetrafluoroethylene resin of the same type as that used in Example 1 was covered with a coating of a solution of fluorocarbon rubber blend containing a vulcanizing agent. The solution was applied to all areas of the outer surface of the tube except the area where the pores had to remain open. After drying and vulcanization, the tube was cut to a desired length. Both ends of the tube were closed with a fluorine rubber plug (9 mm in diameter, 5 mm in thickness) which was also coated with fluorine rubber containing a vulcanizing agent. A support member of the shape indicated at 4 in FIG. 2 was prepared. The tube was fixed to this support member, as in Example 1 to thereby produce a release agent applicator as shown in FIG. 2. In FIGS. 1 and 2, like parts are identified by like reference numerals.

Silicone oil #KF 96 (1000 cS) was injected into the porous tube through both ends. A few minutes later, the silicone oil oozed out through the area of the porous tube where the pores were open.

The applicators of the invention described above eliminate the defects of the prior art applicator (1) and (2) described above. Moreover, the applicators of the invention are capable of applying a uniform coating of release agent in a minimum necessary amount. In addition to this economic advantage, the applicators can be installed in a very small area. Furthermore, if the wall thickness of the porous tube of tetrafluoroethylene resin is sufficiently large, it need not be reinforced with a shape retaining member. The applicators of the invention need be filled only with an amount of release agent that is equal to the amount of consumption while yet providing a uniform application of the release agent. As a further advantage, the applicators have a simple configuration and they can be manufactured at such a low cost that they can be disposed of after use if desired.

What is claimed is:

1. An apparatus for fixing a toner image by transporting a toner image bearing material as it passes between a heated rotating fixing roll and a compression roll comprising: a stationary porous tube of tetrafluoroethylene resin having sealed ends and a release agent therein, said tube being disposed in contact with said fixing roll and being disposed along an axial direction of said fixing roll, said release agent being applied onto a surface of said fixing roll through open pores in said porous tube confronting said fixing roll, said pores in said tube not confronting said fixing roll being sealed.

2. The apparatus according to claim 1 wherein said porous tube of tetrafluoroethylene resin is fixed to a support member.

3. The apparatus according to claim 1 wherein said porous tube of tetrafluoroethylene resin has a pore size of 0.1 to 10 μm, a porosity of 50 to 85%, an outside diameter of 5 to 50 mm, and a wall thickness of 0.1 to 5 mm.

4. The apparatus according to claim 1 wherein said sealed pores are formed by coating said area where the pores are to be sealed with heat-resistant rubber.

5. The apparatus according to claim 1 further comprising a rubber plug 1 to 20 mm thick attached to part of an area of said porous tube of tetrafluoroethylene resin other than an area through which said release agent is to pass, said part providing an inlet for said release agent, said release agent being injected through said part and plug.

6. The apparatus according to claim 1 wherein said ends of said porous tube of tetrafluoroethylene resin are heat sealed.

7. The apparatus according to claim 1 wherein said ends of said porous tube of tetrafluoroethylene resin are sealed with a rubber plug 1 to 20 mm thick, said ends providing an inlet for said release agent, said release agent being injected through said plug.

* * * * *